US006318548B1

(12) United States Patent
Travis

(10) Patent No.: US 6,318,548 B1
(45) Date of Patent: Nov. 20, 2001

(54) EASILY TRANSPORTED CONTACT LENS CARE KIT

(76) Inventor: Aaron T. Travis, 559 Locust Ave., E. Grand Rapids, MI (US) 49506

( * ) Notice: Subject to any disclaimer, the term of this patent is extended or adjusted under 35 U.S.C. 154(b) by 0 days.

(21) Appl. No.: 09/466,293

(22) Filed: Dec. 17, 1999

Related U.S. Application Data

(63) Continuation-in-part of application No. 09/178,959, filed on Oct. 26, 1998, now Pat. No. 6,244,430.

(51) Int. Cl.[7] ..... A45C 11/04
(52) U.S. Cl. ..... 206/5.1; 206/38
(58) Field of Search ..... 206/5, 5.1, 37, 206/37.1, 38, 38.1; 220/23.91; 24/3.6–3.8; 70/429, 430; 134/901; D3/208, 264

(56) References Cited

U.S. PATENT DOCUMENTS

| | | | | |
|---|---|---|---|---|
| D. 196,681 | | 10/1963 | Middleton . | |
| D. 388,602 | | 1/1998 | Petruzzi . | |
| D. 393,148 | | 4/1998 | Petruzzi . | |
| 2,892,537 | * | 6/1959 | Schwartz | 206/38 |
| 3,780,918 | | 12/1973 | Curtis . | |
| 3,918,503 | | 11/1975 | Bundy . | |
| 3,955,726 | | 5/1976 | Reitzel . | |
| 5,002,179 | | 3/1991 | Dhalla . | |
| 5,263,577 | * | 11/1993 | Paratte et al. | 206/38.1 |
| 5,289,915 | * | 3/1994 | Queen | 206/38 |
| 5,375,699 | | 12/1994 | Amend . | |
| 5,415,275 | * | 5/1995 | Girimont | 206/5.1 |
| 5,452,792 | * | 9/1995 | Zautke et al. | 206/5.1 |
| 5,467,871 | * | 11/1995 | DeField | 206/38.1 |
| 5,676,243 | | 10/1997 | Sanders . | |
| 5,711,416 | | 1/1998 | Bauman . | |
| 5,881,867 | * | 3/1999 | Tohill, Jr. et al. | 206/5.1 |

* cited by examiner

*Primary Examiner*—Luan K. Bui
(74) *Attorney, Agent, or Firm*—Young and Basile, P.C.

(57) ABSTRACT

A portable contact lens and fluid storage kit comprising a generally conventional lens case adapted to receive a quick-detachable key ring attachment device so that the case may be carried with a set of keys or similar object worn or carried about a person in a convenient and hard to forget fashion. The key chain attachment device is easily detached so that the case may be separated from the keys and rested on a flat surface during contact lens insertion and removal.

19 Claims, 7 Drawing Sheets

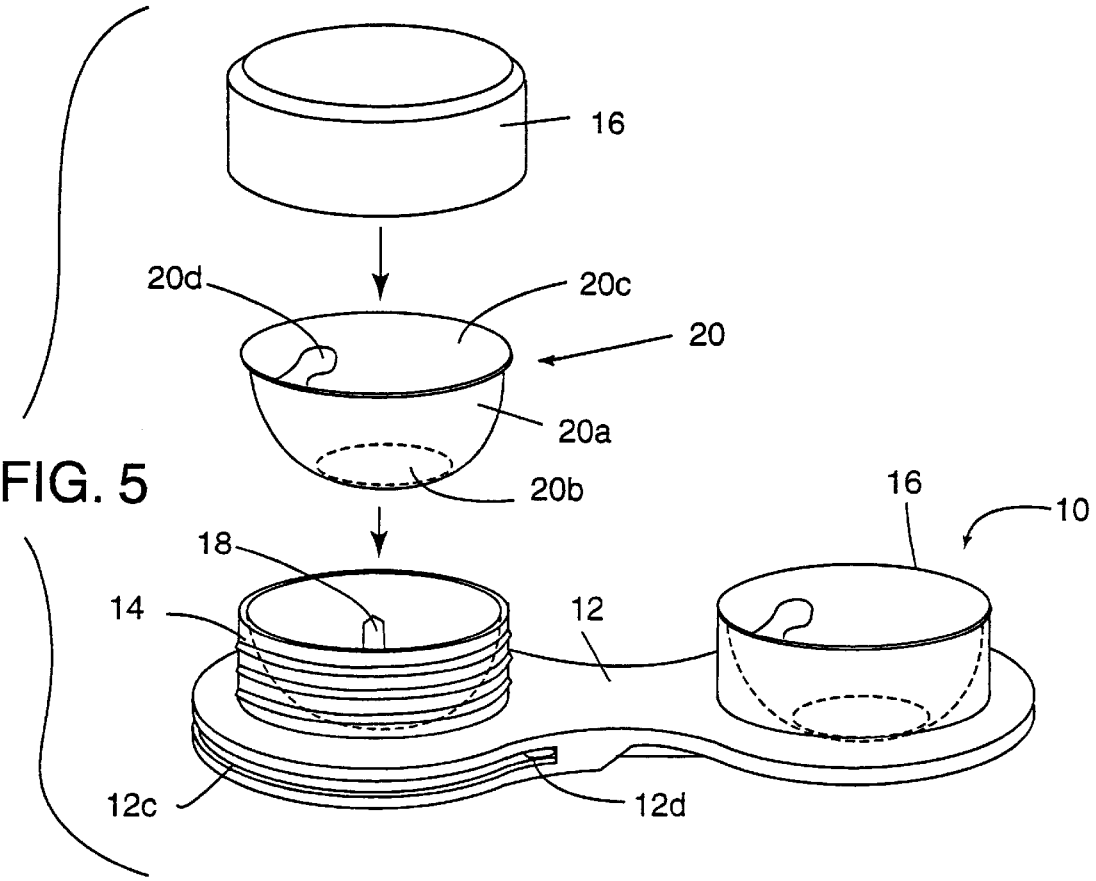
FIG. 5
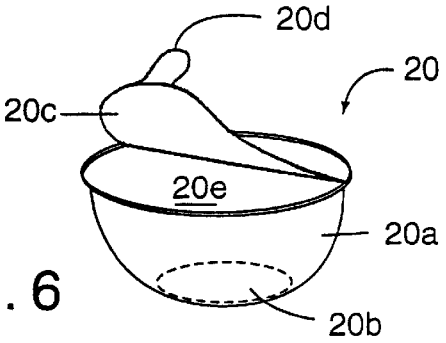
FIG. 6
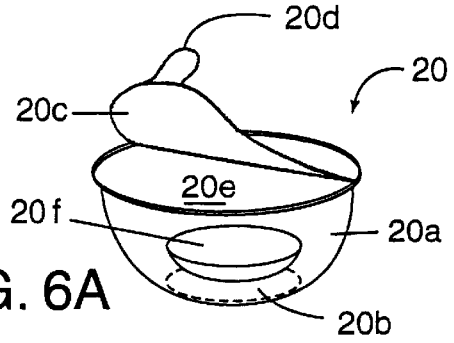
FIG. 6A
FIG. 7
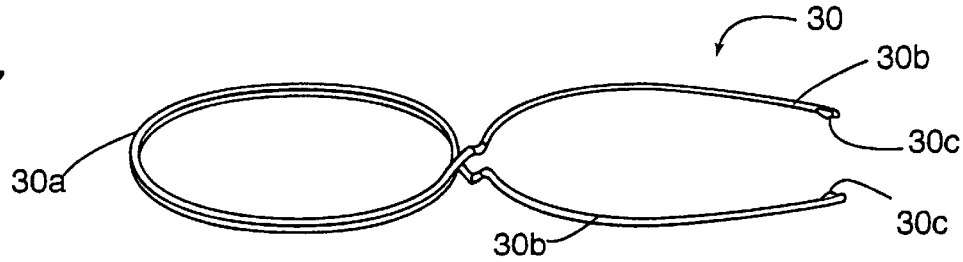

EASILY TRANSPORTED CONTACT LENS CARE KIT

This application is a C.I.P. of U.S. patent application Ser. No. 09/178,959, filed Oct. 26, 1998, U.S. Pat. No. 6,244,430.

FIELD OF THE INVENTION

This invention is in the field of contact lens storage cases.

BACKGROUND OF THE INVENTION

People who use contact lens, whether of the rigid or soft variety, always need something handy in which to store them. The reasons vary: unexpected overnight stays away from home; travel; activities where there is a need or likelihood for frequent contact lens removal and replacement. This storage device must hold fluid to keep the lens lubricated and must be sealed so as not to allow bacteria to enter. Without fluid the lenses can become damaged or destroyed.

Quite often, a contact lens wearer will get a foreign object in the eye (e.g., an eyelash or dirt particle) that causes irritation. In such cases, the contact lens must be removed from the eye and cleaned, and then re-inserted into the eye or stored in suitable fluid. Should this type of minor emergency happen when a contact lens case is not readily available, a frantic search begins for some sort of alternate moist storage container, such as a cup of water. However, this is not a sanitary solution on either a short or long term basis. Another known solution for such emergency storage is to lubricate the lens with saliva after taking it out, and then to re-insert it into the eye. This is probably the worst solution, as saliva is acidic and damaging to the eye.

While most contact lens storage devices are relatively small and easy transportable, their necessity is often forgotten until an emergency arises. There is currently no simple, effective way to ensure that a case will always be available. Some keep extra cases in their glove compartments. Some carry cases in purses or backpacks. However, despite their efforts, contact lens wearers still frequently find themselves without their contact lens cases.

A few portable lens case devices do exist for facilitating storage of the case on one's person. U.S. Pat. No. 3,955,726 shows a pendant for storing contact lens, hung from a chain around the neck. U.S. Pat. No. 3,780,918 discloses a wristwatch capable of storing contact lens. U.S. Pat. No. 5,002,179 shows a fluid-storing lens case resembling a pen.

Yet even with such known portable lens cases, having a contact lens case alone is not a complete solution to the aforementioned problem of temporary or emergency lens storage. Most contact lenses require special fluids for cleaning, disinfecting and storing them. The bottles containing these fluids are much larger than lens cases, and therefore reduce the portability of any complete lens care kit. To resolve this, some people are known to keep soaking solution in the lens compartments of a standard lens case. Unfortunately, the stored fluid tends to leak out if the top of the case is not closed tightly enough, and ultimately evaporates. Additionally, if the fluid-filled case leaks, bacteria has the ability to get inside and contaminate the fluid in which the contact lenses will eventually be stored.

Attempts have been made to solve the fluid storage problem. U.S. Pat. No. 5,375,699 shows a contact lens case with a rubber 'O'-ring around the rim of the storage area to prevent leakage of fluid stored in the lens compartments.

U.S. Pat. No. 5,711,416 shows a disposable contact lens storage unit with a sealed top to prevent air or fluid from entering or escaping.

SUMMARY OF THE INVENTION

The present invention solves the foregoing problems in two complementary ways. First, a conventional lens case is provided with a quick-detachable key ring or key chain attachment releasably locked to a specially formed horizontal portion of the lens case. For example, conventional lens cases generally comprise two cylindrical, cap-sealed cups located on either end of a relatively flat, horizontal, web portion. In a first form of the present invention, one or more portions of the cup-connecting web is provided with a groove or recess adapted to lockingly receive matingly contoured spring lock arms of the key ring attachment. In a preferred form the recess for the lock arms is formed in the edge of the horizontal web, such that the key ring attachment is mated with the lens case in a horizontal, parallel plane which allows the case to be rested on a flat surface.

In a further preferred form the key ring attachment device is formed from a single piece of spring wire, with a closed loop on one end for attachment to a key chain, and two integral, opposed spring lock arms with a contour and spacing adapted to snap over and around the portion of the lens case web in a friction fit, preferably further enhanced by the recessing of the lock arms into the groove in the edge of the web, and even further by knobs or tabs on the end of the lock arm which mate with detents in the groove.

The key ring attachment remains securely locked to the case until its spring lock arms are forced apart, allowing the case to be quickly and easily separated from the key chain so that it can be laid flat on a narrow surface such as the edge of a sink.

In a most preferred form of the invention, the cup-connecting web of the lens case is provided with one-half of a resilient locking finger mechanism of the type disclosed by Tracy, in U.S. Pat. No. 4,150,464. These resilient locking finger connectors typically comprise a female finger-receiving receptacle, and a male finger connector adapted to be inserted into the female receptacle and releasably locked thereto by the resilient engagement of one or more fingers with portions of the receptacle. A well-known version of this type of resilient locking finger connector is sold commercially under the brand name "Fastex®". Many variations on this basic finger/receptacle connector structure are known and commercially available, and can be adapted for use with the present invention.

In the preferred form of the invention, a first half of the connector (e.g., the female receptacle) is formed on the lens case, preferably on one end thereof, as an integral extension of the cup-connecting web portion of the lens case. The other half of the connector (e.g., a male half) has a loop, clip, or other convenient keychain type attachment so that the lens case with the connector halves mated can be attached to a key ring, a key chain, or a similar object worn or carried about a person.

With the portability and availability of the lens storage case itself solved by the key ring attachment feature above, the fluid storage problem is solved by way of novel fluid-holding cup inserts which fit precisely into the lens cups in the lens case. The fluid-holding inserts of the present invention comprise in one preferred form disposable plastic blisters or bubbles of sterile, sealed lens fluid with removable plastic or foil tops. The inserts drop into the lens cups and are secured with the standard lens cup caps without the need for external sealing structure on the case such as lens cup O-rings. The fluid inserts are designed to hold just enough fluid to fill their respective lens cups and still allow a contact lens to be placed in the fluid inside the cup for storage, soaking or cleaning.

In the event that a contact lens needs to be removed from the eye and temporarily stored or cleaned in the case, the user simply unscrews the cap from a lens cup, removes the fluid insert, peels back its top, pours the fluid back into the lens cup, and places the contact lens in the now fluid-filled cup until ready for use.

These and other features of the present invention will be better understood upon reading the following specification with reference to the drawings.

BRIEF DESCRIPTION OF THE DRAWINGS

FIG. 5 is a side perspective view of the lens case of FIG. 1, with an exploded representation of one of the lens cups, a removable fluid insert according to the invention, and the lens cup cap;

FIG. 6 is a side perspective view of a fluid insert according to the present invention, illustrating a disposable type with a peelaway cover partly removed;

FIG. 6A illustrates the fluid insert of FIG. 6 with an optional disposable contact lens stored therein;

FIG. 7 is a perspective view of a key ring attachment according to the invention, adapted to removably lock onto the lens case of FIG. 1;

DETAILED DESCRIPTION OF THE ILLUSTRATED EMBODIMENTS

Figure 1:
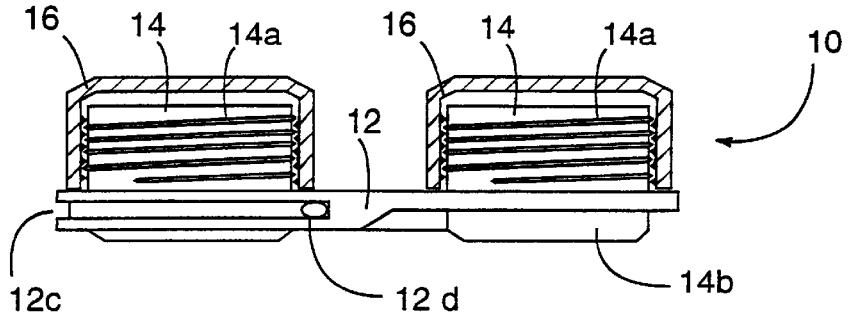
FIG. 1 is an elevated side view of a lens case according to the present invention, with lens cup caps sectioned for clarity.

Referring first to FIGS. 1–4, a preferred example of a lens case 10 according to the present invention comprises a flat, horizontal web portion 12, and two spaced cylindrical cups 14 adapted to each hold a contact lens, the cups 14 having external threads 14*a* for receiving threaded caps 16. Lens case 10 is preferably integrally molded from a suitable plastic material, as is common in the art, although other known materials and methods of manufacture could be used.

In the illustrated lens case example, web portion 12 is somewhat "8" or "dog bone" shaped, in that it has rounded, circular ends 12*a* containing cups 14, and a curved, narrowed middle region 12*b*. So far the structure described for lens case 10, including the shape of web 12, is conventional. It will be understood by those skilled in the art that other styles of lens case are commercially available, and that the invention is adaptable to different types of lens cases with only minor modifications.

In accordance with the present invention, at least one of the rounded ends 12*a* of web 12 is provided with a peripheral locking groove 12*c* extending at least partway into the narrowed middle region 12*b* of the web. In the illustrated embodiment, locking groove 12*c* is recessed into the web and terminates on either side of the web in detent holes 12*d* for a purpose described below.

Figure 2:
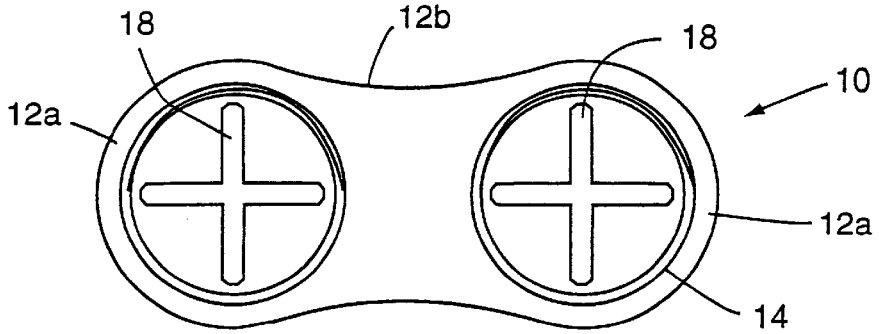
FIG. 2 is a plan view of the lens case of FIG. 1 with the caps removed.

Referring to FIG. 2, cups 14 are provided with cruciform slots 18 formed in the bottom surface of each cup to prevent the contact lenses from sticking to the bottom surface of a moistened cup by capillary suction. Slots 18 are generally known in the art.

Figure 3:
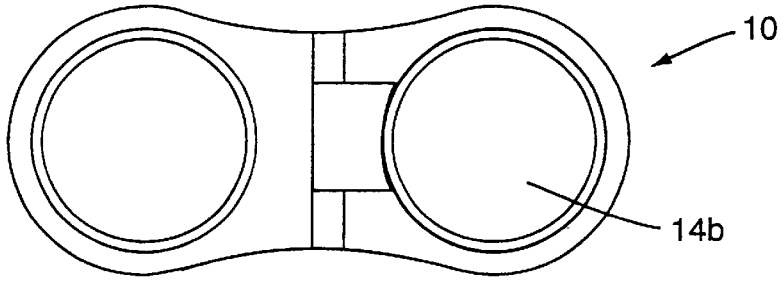
FIG. 3 is a bottom plan view of the lens case of FIG. 1.

Referring to FIG. 3, in the illustrated embodiment only one end of web 12 is provided with a locking groove 12*c*, while the opposite end of the web has a reduced thickness which allows the lower portion 14*b* of its respective cup 14 to be grasped by the fingers and pulled for a purpose described below. Of course, it is possible to construct lens case 10 according to the invention with a locking groove 12*c* in both ends, but for simplicity of illustration herein, a version of lens case 10 with a single locking groove 12*c* is shown and described.

Figure 4:
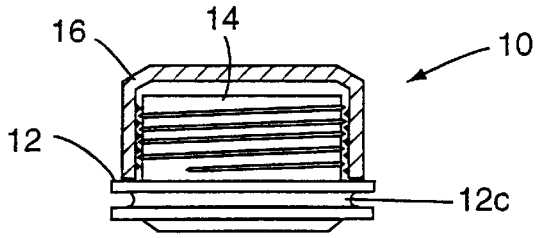
FIG. 4 is an end elevational view of a key ring attachment end of the lens case of FIG. 1.

FIG. 4 clearly shows the recessed nature of locking groove 12*c*, such that upper and lower portions of web 12 overhang the groove.

Referring next to FIGS. 5 and 6, lens case 10 is shown provided with novel fluid inserts 20 shaped to fit snugly within cups 14 and to be contained therein by caps 16. Fluid inserts 20 preferably comprise disposable plastic bubbles or blisters 20*a* containing a small amount of known contact cleaning or storage solution 20*e* sufficient to fill one of cups 14 to a desired level. Fluid inserts 20 are sealed, in the illustrated disposable embodiment by a peelaway cover 20*c* comprising a known type of paper, plastic or foil secured in fluid tight and airtight fashion to the upper edge of plastic blister 20*a*. Cover 20*c* in the illustrated embodiment is provided with a peelaway actuator tab 20*d* of known type.

Fluid inserts 20 are generally cup- or bowl-shaped to fit in cups 14, and further preferably have flat bottoms 20*b* to allow them to stand on a flat, even surface (such as a sink or counter top) without tipping.

It will be understood that while fluid inserts 20 are illustrated in a preferred form as being disposable, it is also possible, although less desirable, to use reusable, resealable fluid-containing inserts of generally the same size and shape and fluid-holding capacity.

In a further alternate embodiment of the invention, fluid inserts 20 contain not only a specified amount of storage fluid, but also a disposable contact lens of commercially available type. Because fluid inserts 20 are already shaped to conform with the interior dimensions of the lens cups, they are perfectly adapted to carry the lenses themselves.

Once fluid inserts 20 are inserted in cups 14, and secured therein by caps 16, they can be transported indefinitely without risk of leakage or evaporation. They also remain sanitary for the hermetically-sealed shelf life of the lens fluid contained therein. The rigid lens case and cup construction protects the relatively thin-walled fluid inserts from being crushed or punctured.

It will be understood by those skilled in the art that the slots 18 in the bottom surface of cups 14 also help to prevent fluid inserts 20 from sticking to the bottom surface of the cups by capillary suction or otherwise.

In a further form, fluid inserts 20 are transparent so that the user may readily ascertain the appearance and condition of the fluid inside without having to open them.

Referring next to FIGS. 7–11, a preferred form of the key chain attachment device of the present invention is illustrated at 30, comprising in a preferred form a single piece of springy, resilient metal wire of known type. Key ring attachment device 30 generally comprises a closed loop 30a which can be securely attached to a key ring or key chain; spaced spring arms 30*b* with a somewhat U- or horseshoe-shape, and spring arm detent ends 30*c*. Ends 30*c* of spring arms 30*b* are spaced in their relaxed position by a distance slightly less than the side to side width of the rounded end 12*a* of lens case 10, and are adapted to horizontally slide into locking groove 12*c* in web 12.

While the illustrated example of attachment device 30 is of a preferred construction, size and shape, it will be understood that the device as a whole or various portions such as the closed loop 30*a* can vary in these parameters.

Figure 8:
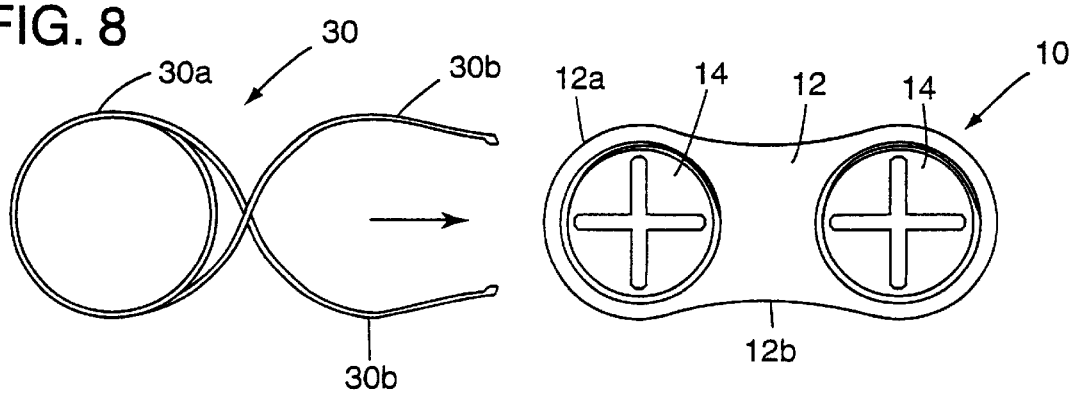
FIG. 8 is an exploded plan view of the lens case of FIG. 1 and the key ring attachment device of FIG. 7, prior to being assembled.
Figure 9:
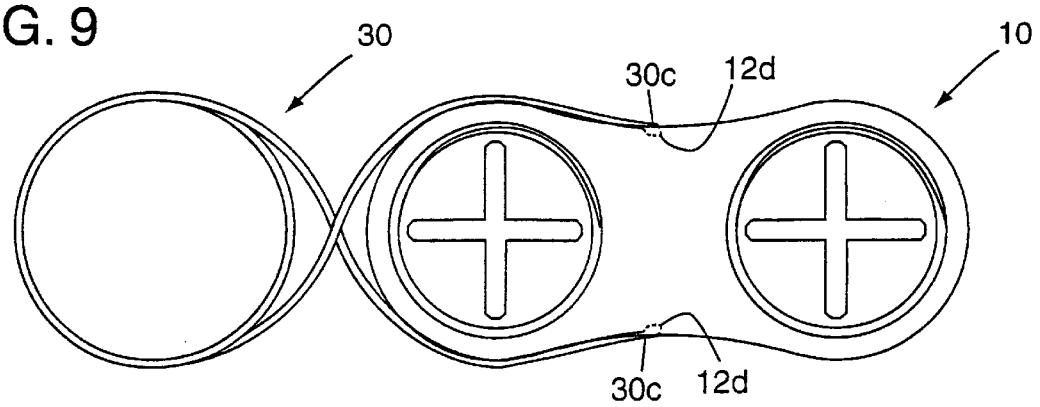
FIG. 9 is a plan view of the lens case and key ring attachment of FIG. 8, assembled.
Figure 10:
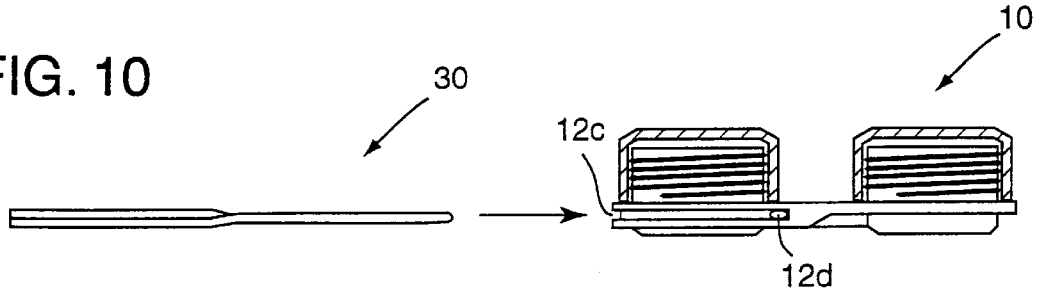
FIG. 10 is a side elevational view of the separated lens case and key ring attachment of FIG. 8.
Figure 11:
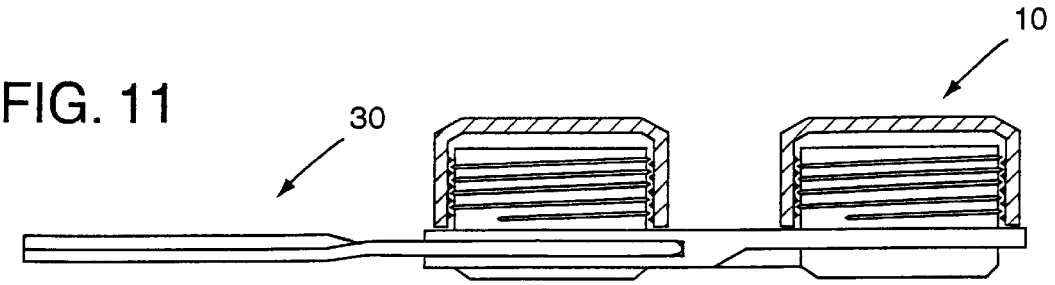
FIG. 11 is a side elevational view of the mated lens case and key ring attachment shown in FIG. 9.

Referring to FIG. 8, the plane of the fork-like spring arms of the attachment device 30 is aligned with the plane of web 12 and then the arms are forced over rounded end 12*a* into locking groove 12*c* in a resilient spring fit wherein they are first slightly forced apart at the widest diameter portion of rounded end 12*a*, and then draw back together as they proceed toward detent holes 12*d* in the ends of locking groove 12*c* located at the narrower middle region 12*b* of web 12. The resilient spring strength of locking arms 30*b* is preferably sufficient to create a strong friction fit with rounded end 12*a* of the lens case, such that a conscious effort is required to separate them. However, the locking connection between attachment device 30 and web 12 can be further enhanced by detents 30*c* on the ends of spring arms 30*b*, which snap into detent holes 12*d* in the ends of locking groove 12*c*. Depending on the depth of the detents and the strength of the spring arms, the attachment device can be configured to pull apart with sufficient force, or can be configured to first require spring arms 30*a* to be spread apart, for example by a squeezing or prying force, before they can be separated from the lens case.

It will be apparent to those skilled in the art, and to contact lens wearers, that lens case 12 using the inventive key chain attachment device 30 according to the invention can quickly and easily be detached from the key chain so that it can be rested on a narrow, flat surface such as the edge of a sink or bathroom counter. In this manner there is no need to fumble with a case attached to a set of keys while removing the fluid inserts or inserting contact lenses. Where counter space is sufficient, the planar nature of attachment device 30 and its alignment with web 12 may allow case 10 to rest in level fashion on a flat surface, even with a key chain attached.

Figure 12:
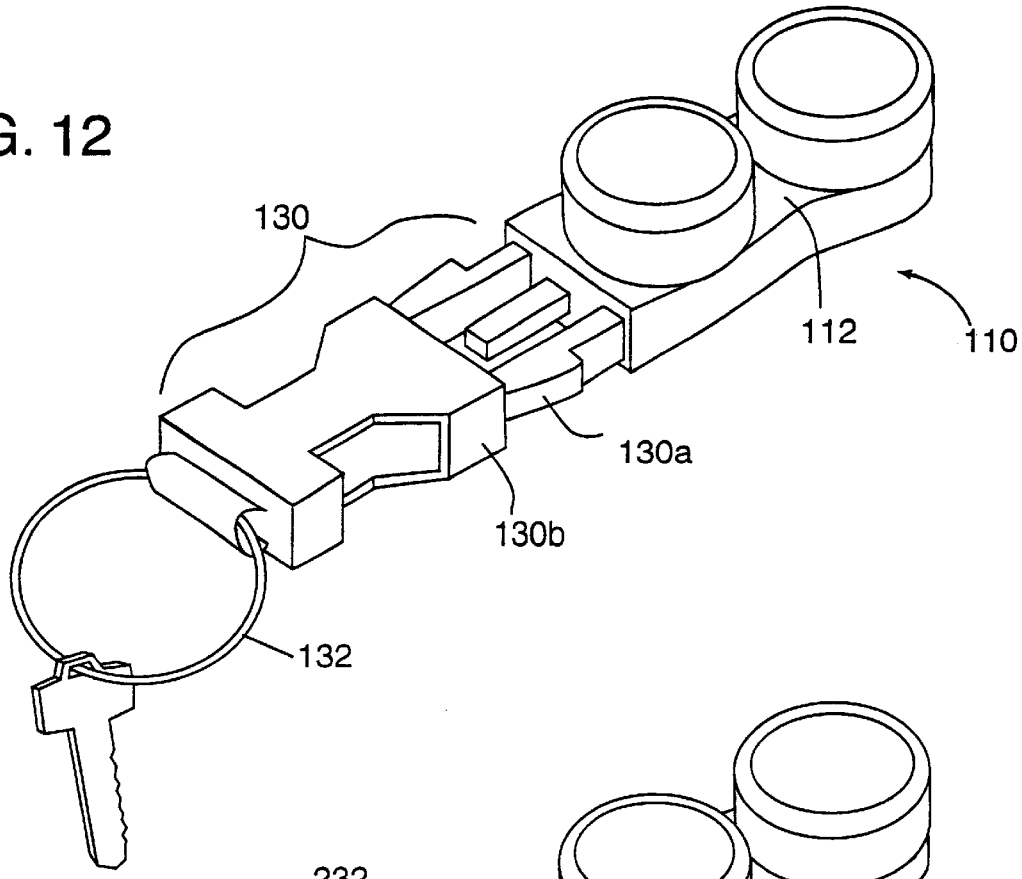
FIG. 12 is a perspective view of an alternate key attachment mechanism for a lens case according to the present invention.
Figure 13:
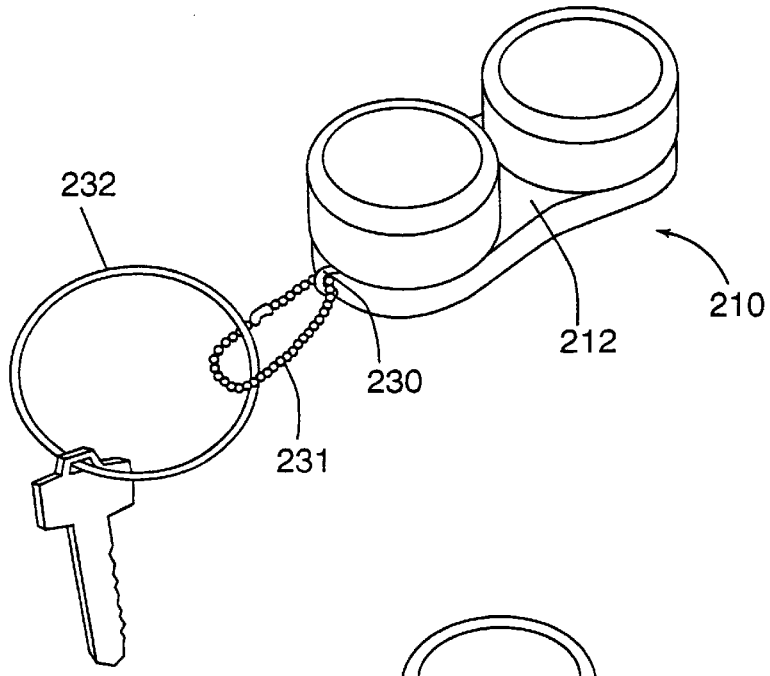
FIG. 13 is a perspective view of a second alternate embodiment of a key attachment mechanism for lens case according to the present invention.
Figure 14:
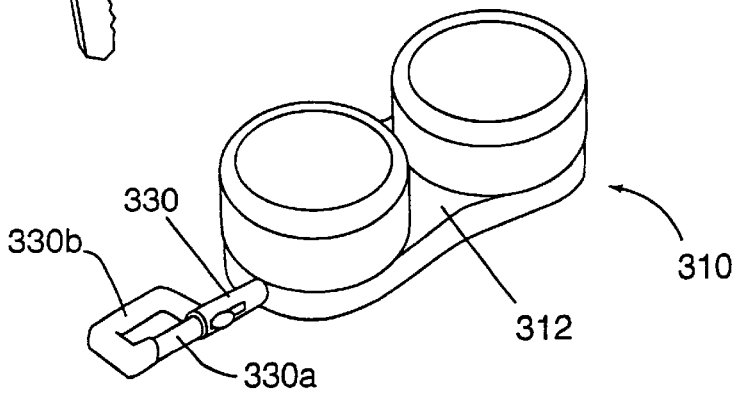
FIG. 14 is a third alternate embodiment of a key attachment mechanism for a lens case according to the present invention.

Referring to FIGS. 12–14, three alternate embodiments of the key chain attachment mechanism are illustrated using attachment structure which is known in the art. FIG. 12 illustrates an alternate lens case 12 with a resilient finger buckle mechanism of a generally known type, for example a Fastex® brand fastener, incorporated or connected to the lens case and then in turn connected to a key chain or key ring. In the illustrated embodiment of FIG. 12, the male portion of the resilient finger connector is made from plastic, and is either integrally formed with the lens case or secured thereto. The female portion of the connector is attached to a key ring.

Referring to FIG. 13, a second alternate key chain attachment mechanism is illustrated as a simple, bead-type key chain which is well known in the art, secured to one end of the lens case 12 by an eyelet through which the chain is threaded and then closed. A standard key ring is shown attached to the bead-type chain, and can be released therefrom in known manner. Referring to FIG. 14, a third alternate attachment mechanism of known type is illustrated, comprising a known type of generally D-shaped hook with a spring-loaded, thumb-operated plunger which can be temporarily depressed to place a key, key ring or key chain into the hook portion, and which then locks closed when released. Again, this key chain attachment device can be integrally formed with the lens case, for example being made from plastic or metal, or can be secured to the lens case in either permanent or removable fashion.

Referring next to FIGS. 15–26, a preferred variation of the lens case and finger buckle mechanism of FIG. 12 is generally denoted by reference numeral 110. The lens case 110 has a body or web portion 112 similar to that shown in FIGS. 1–14, but with a finger buckle receptacle 112*c* formed into one end instead of the previously-described peripheral locking groove 12*c*. Receptacle 112*c* is preferably integrally molded with the plastic lens case 110, and in the illustrated embodiment comprises the female half of a male/female connector of a type generally known in the art. A popular brand is the "Fastex®" brand connector system, although many variations of this style of connector mechanism are known and available, and all such equivalents can be adapted for use with the present invention. It should also be understood that while the female receptacle 112*c* is illustrated as being formed integrally with the lens case in FIGS. 15–26, an opposite arrangement with the male half formed integrally with the 10, lens case as shown in FIG. 12 can also be used.

Receptacle 112*c* extends away from web 12 in a plane, preferably parallel to or even co-planar with the web 112 and lens case 110. In the illustrated embodiment, locking receptacle 112*c* is extruded from the end of the horizontal web portion 112*a*.

Figure 15:
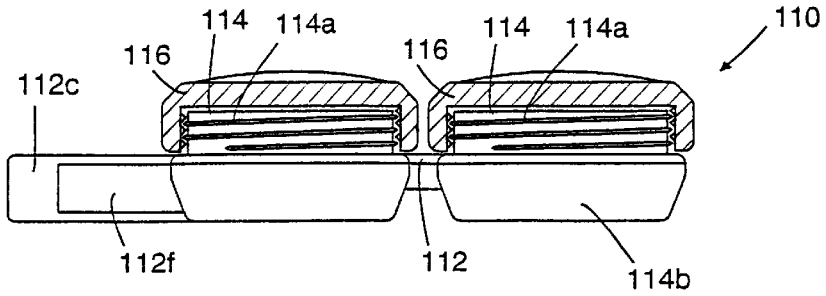
FIG. 15 is a side elevational view, partly in section, of a preferred form of the invention generally shown in FIG. 12 above.
Figure 16:
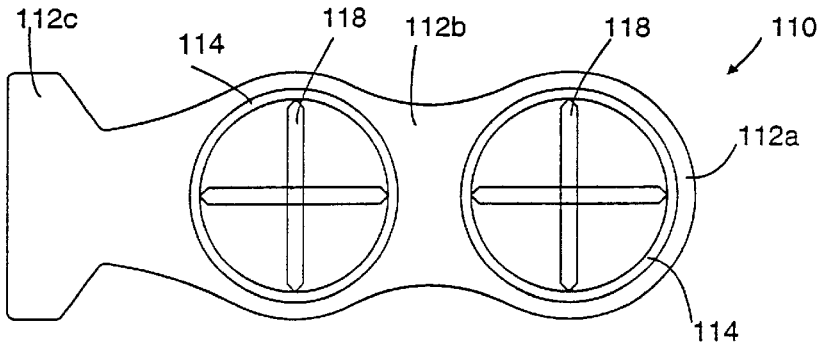
FIG. 16 is a top plan view of FIG. 15, with the lens cup covers removed.
Figure 17:
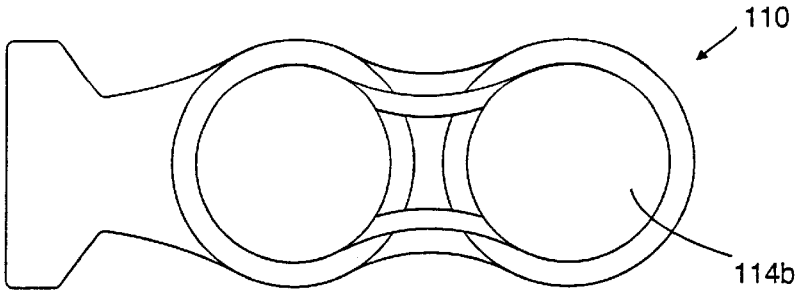
FIG. 17 is a bottom plan view of FIG. 15.
Figure 18:
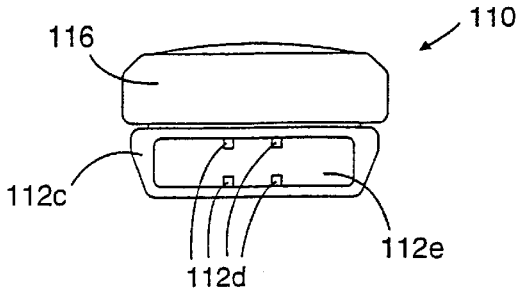
FIG. 18 is a left-hand view of FIG. 15, looking into a receptacle formed on the end of the lens case.
Figure 19:
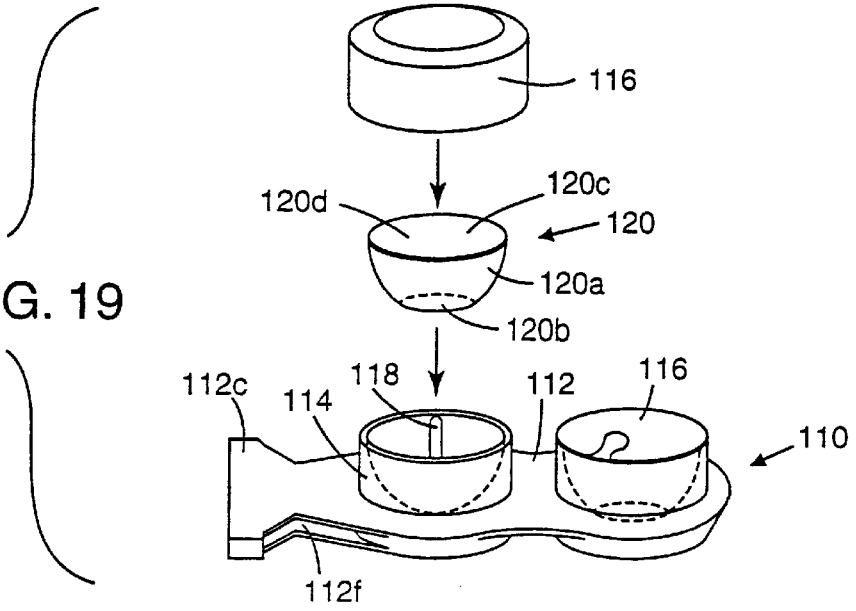
FIG. 19 is a perspective view of the lens case of FIG. 15, with an exploded representation of one of the lens cups, a removal fluid insert, and a lens cup cap with cover.
Figure 20:
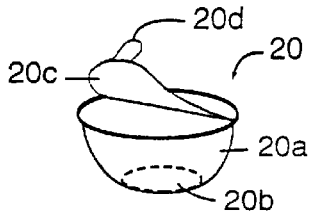
FIG. 20 is a perspective view of a fluid insert of a disposable type with a peelaway cover partly removed.
Figure 20A:
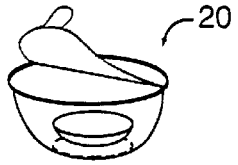
FIG. 20A illustrates the fluid insert of FIG. 20 with an optional disposable contact lens stored therein.
Figure 21:
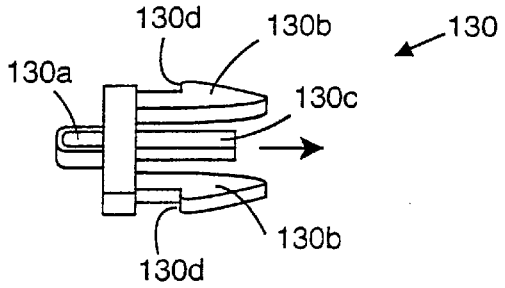
FIG. 21 is a perspective view of a male connector half of the resilient locking finger type, with a key ring type attachment loop according to the invention.

FIG. 18 illustrates receptacle 112*c* from its open end, and in particular illustrates a somewhat rectangular receptacle opening 112*e* and a plurality of guide bars 112*d* extending inwardly from the opening. As best shown in FIGS. 15 and 19, the hollow interior of female receptacle 112*c* opens at 112*f* on both sides of the receptacle.

Referring next to FIGS. 21–26, the removable portion of the key chain attachment device incorporated into lens case 110 is generally illustrated at 130 as the male, multi-fingered half of the connector system. Male connector 130 is adapted to be mated in a releasable locking fit with receptacle 112*c* in generally known manner. Male connector 130 is preferably formed from a single piece of at least semi-rigid but flexible rubber or plastic of known type. At its outermost end it includes a loop or clip 130*a*, in the illustrated form a closed loop integrally molded with connector 130, for secure attachment to a key ring, key chain or other convenient, similar attachment point on an object normally carried on or about a person. It will be understood that the closed loop illustrated at 130*a* in FIGS. 21–26 is simply one preferred form, and that it may take other shapes and structures of known type, for example split rings, spring-loaded or flexible clasp hooks of the type shown in FIG. 14, and other key chain adaptable connecting structures.

Figure 22:
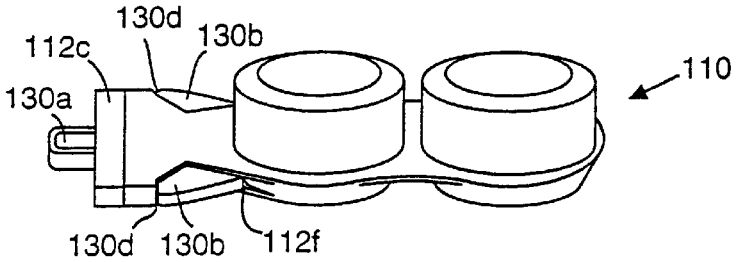
FIG. 22 is a perspective view of the lens case of FIG. 15 with the male connector half of FIG. 21 mated thereto.

In the illustrated, exemplary embodiment, male connector 130 comprises spaced spring arms 130*b* with a somewhat fork-like shape, and a central guide arm 130*c*. The free ends of spring arms 130*b* are spaced apart in their relaxed position by a distance approximating the side to side width of opening 112*e* and locking receptacle 112*c* on lens case 110. However, the spring arms are angled outwardly from their free ends to define cam-like side surfaces which are wider than opening 112*e* and receptacle 112*c*, resulting in the spring arms being displaced inwardly upon insertion into receptacle 112*c* until the outwardly-angled portions, and in particular shoulder portions 130*d*, enter side openings 112*f*, whereupon the spring arms pop back apart to their relaxed position as shown in FIG. 22. At this point male connector 130 and female receptacle 112*c* (and hence entire lens case 110) are axially locked to one another and cannot be separated without a deliberate opening action of the type shown in FIG. 23.

Figure 23:
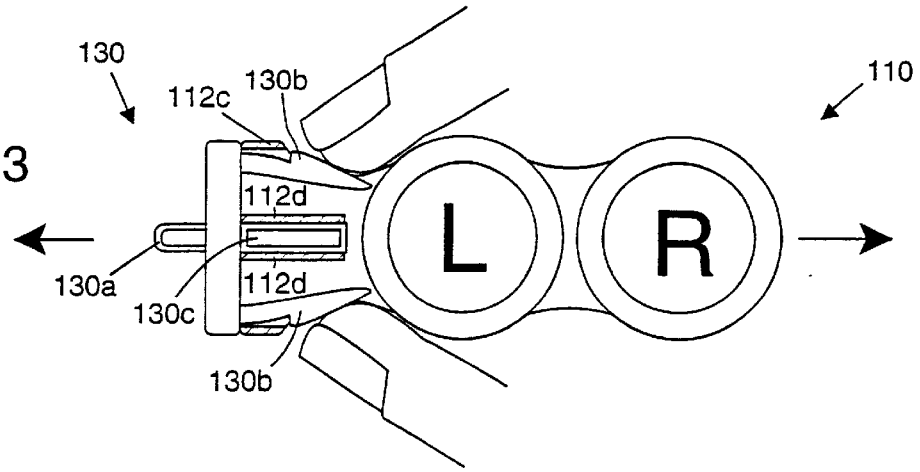
FIG. 23 is a plan view of FIG. 22, illustrating an unlocking pressure being applied by human fingers to the locking fingers of the male connector half.

FIG. 23 illustrates the fingers of a person using the invention, squeezing sections 130*b* of male connector inwardly into openings 112*f* in the receptacle, and a simultaneous outward force being exerted on the male connector as shown by the left-most arrow. At the same time, an opposite force can be applied to lens case 110 as indicated by the right-most arrow. Receptacle 112*c* in FIG. 23 is shown partially sectioned, to illustrate the guiding fit between guiding bars 12*d* in the receptacle and guide arm 130*c* on male connector 130.

Figure 24:
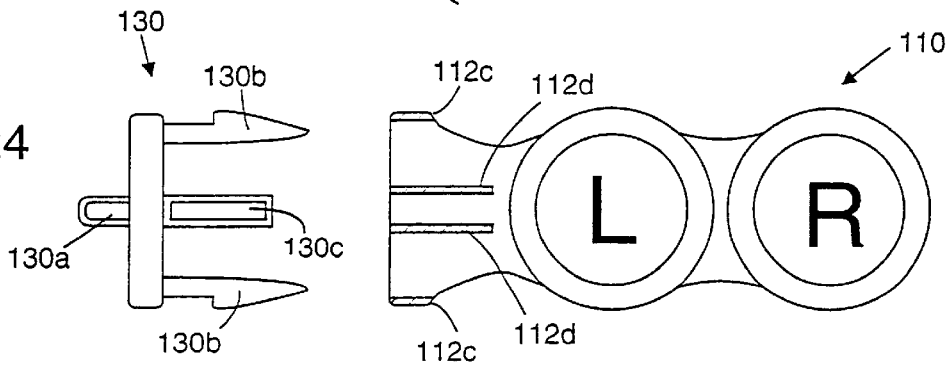
FIG. 24 is a plan view of FIG. 23, with the male connector half disengaged from the receptacle and the lens case.
Figure 25:
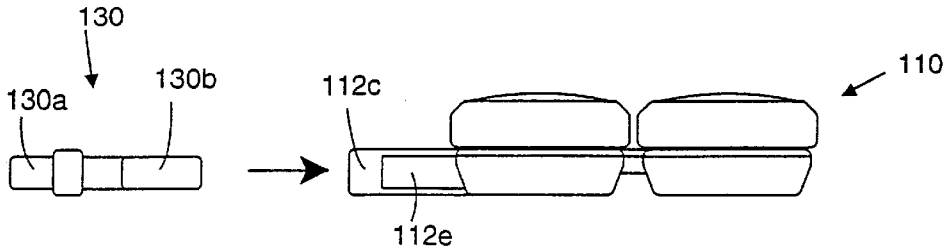
FIG. 25 is a side elevational view of FIG. 24, with an arrow illustrating the direction of insertion into the lens case receptacle.
Figure 26:
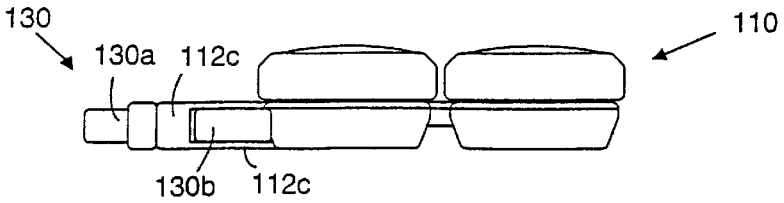
FIG. 26 is a side elevational view of FIG. 22.

FIG. 24 illustrates male connector 130 separated from receptacle, and illustrates the relative widths of arms 130*b* and opening 112*e*. FIGS. 25 and 26 illustrate the connection of male connector 130 with receptacle 112*c* from a side elevational view, and give a clear illustration of the locking position of portions 130*b* and side openings 112*e* on the receptacle.

Again, while the illustrated embodiment shows a preferred version with a pair of flat, generally planar male connector arms 130*b* and a flat, generally planar locking receptacle 112*c*, other types of snap-together connectors can be used with the present invention. The arrangement illustrated, however, is much preferred and is believed to provide several advantages, including the fact that the entire assembly including the lens case is essentially flat, thereby allowing it to be rested on a flat surface such as a counter top or the edge of a sink.

It should also be understood that the use of the connector illustrated at 112*c* and 130 in FIGS. 15–26 allows a lens case according to the invention to be quick-connected to any mating connector structure on items such as luggage, backpacks, belts and the like, provided the male and female connector portions are a compatible design and/or brand, and are of the same size. The wide availability and use of this type of connector on luggage allows a lens case 110 incorporating either the male or female half of the system to be coupled to virtually any object using such connector structure of a compatible kind. The utility of the invention for travel involving backpacks or luggage is therefore readily apparent now that I have disclosed my invention. Of course, the embodiment of the inventions shown in FIGS. 15–26 also allows a reliable and quick-release attachment of the inventive lens case to a key chain or key ring.

It will be understood by those skilled in the art that the foregoing illustrated embodiments of my invention are described and illustrated in a preferred form for purposes of explanation, and are not intended to be limiting examples, as the fluid inserts and key ring attachment structure are susceptible of modification without departing from the scope of my invention as described in the following claims.

Accordingly, I claim:

1. A combination contact lens case and connection mechanism comprising:

two contact lens cups, each cup capable of storing or transporting a contact lens;

a substantially planar lens case body joining the two cups;

a connector comprising first and second rigid connector parts adapted to uniquely axially mate with one another, the first rigid connector part being integrated with the lens case so as to form a rigid, substantially planar extension of the lens case body, and the second rigid connector part separate from the lens case and releasably connected to the first connector part so as to form a removable rigid, substantially planar extension of the lens case body and first rigid connector part, wherein the second connector part includes a key chain adapter means for securing the second connector part to a key chain-type attachment on an object worn or carried about a person.

2. The apparatus of claim 1, wherein the key chain adapter means comprises a closed loop portion for securing the second connector part to a key chain-type attachment on an object worn or carried about a person.

3. The apparatus of claim 1, wherein the connector comprises a male/female connector, the first connector part comprising one of a male and female connector, and the second connector part comprising one of a female and male connector, such that the first and second connector parts mate in male/female or female/male fashion.

4. The apparatus of claim 3, wherein the first connector part comprises a first half of the male/female connector, and the second connector part comprises a second half of the male/female connector.

5. The apparatus of claim 1, wherein the first connector part comprises one-half of a finger buckle-type connector and the second connector part comprises the second half of a finger buckle-type connector.

6. The apparatus of claim 5, wherein the connector comprises a finger buckle-type connector in which one part is a female receptacle and another part is a male connector adapted to be mated with the female receptacle in axially locking fashion.

7. The apparatus of claim 6, wherein the male connector is adapted to be inserted in the female receptacle in axially locking fashion.

8. The apparatus of claim 1, wherein the lens case has a planar portion sufficient to rest the lens case on a flat support with the two cups facing upwardly.

9. The apparatus of claim 8, wherein the connector comprises an extension of the lens case which is generally parallel to the planar portion of the lens case.

10. The apparatus of claim 1, wherein the mated first and second rigid connector parts define two separate release points which must be operated to disconnect the first and second rigid connector parts.

11. A contact lens case comprising:

two contact lens cups, each cup capable of storing or transporting a contact lens;

a lens case body joining the two cups;

a connector integrated with the lens case, the connector comprising first and second connector parts, the first connector part comprising a part specially adapted to mate only with parts of the second connector part type, and the second connector part comprising a part specially adapted to mate only with parts of the first connector part type, the first and second connector parts being integrated with the lens case, and the second connector part being releasably locked to the first connector part, wherein the first connector part comprises one-half of a finger buckle-type connector and the second connector part comprises the second half of a finger buckle-type connector.

12. The apparatus of claim 11, wherein the second connector part forms a rigid extension of the first connector part and the lens case when releasably locked to the first connector part.

13. The apparatus of claim 11, wherein the second connector part further includes key chain adapter means for securing the second connector part to a key chain type attachment on an object worn or carried about a person.

14. The apparatus of claim 11, wherein the first connector part is integrated with the lens case body.

15. The apparatus of claim 11, wherein the first connector part is integrated with at least one of the cups.

16. The apparatus of claim 11, wherein the lens case has a planar portion sufficient to rest the lens case on a flat support with the two cups facing upwardly, and further wherein the first connector part comprises an extension of the lens case which is generally parallel to the planar portion of the lens case.

17. The apparatus of claim 16, wherein the second connector part comprises a generally planar extension of the first connector part and therefore is generally parallel to the planar portion of the lens case when releasably locked to the first connector part.

18. The apparatus of claim 11, wherein the first and second connector parts mate in axial locking fashion.

19. The apparatus of claim 13, wherein the key chain adapter means comprises a closed loop portion for securing the second connector part to a key chain-type attachment to an object worn or carried about a person.

* * * * *